US007640605B2

(12) United States Patent
Kollmann et al.

(10) Patent No.: US 7,640,605 B2
(45) Date of Patent: Jan. 5, 2010

(54) SHOWER SUPPORT

(75) Inventors: Fabian Kollmann, Stuttgart (DE); Tom Schoenherr, Stuttgart (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 10/538,554

(22) PCT Filed: Dec. 12, 2003

(86) PCT No.: PCT/EP03/14099

§ 371 (c)(1),
(2), (4) Date: Jan. 9, 2006

(87) PCT Pub. No.: WO2004/055280

PCT Pub. Date: Jul. 1, 2004

(65) Prior Publication Data

US 2006/0130229 A1 Jun. 22, 2006

(30) Foreign Application Priority Data

Dec. 13, 2002 (DE) ..... 102 60 211
Dec. 13, 2002 (DE) ..... 102 60 212

(51) Int. Cl.
*A47K 3/20* (2006.01)

(52) U.S. Cl. ..... 4/570

(58) Field of Classification Search ..... 4/615–617, 4/604–605, 601, 570, 567; 248/284.1, 291.1; 239/282–283
See application file for complete search history.

(56) References Cited

U.S. PATENT DOCUMENTS

| | | | | |
|---|---|---|---|---|
| 2,276,779 | A | 3/1942 | Isenberg | |
| 4,091,998 | A * | 5/1978 | Peterson | 239/283 |
| 4,174,822 | A * | 11/1979 | Larsson | 248/75 |
| 4,719,654 | A * | 1/1988 | Blessing | 4/597 |
| 4,752,975 | A * | 6/1988 | Yates | 4/601 |
| 5,855,348 | A * | 1/1999 | Fornara | 248/291.1 |
| 5,855,384 | A | 1/1999 | Pike et al. | |
| 6,442,775 | B1 | 9/2002 | Gransow et al. | |
| 2006/0059616 | A1 * | 3/2006 | Grohe | 4/615 |

FOREIGN PATENT DOCUMENTS

| | | |
|---|---|---|
| CH | 340460 | 10/1994 |
| DE | 89 16 188.2 U1 | 9/1959 |
| DE | 70 08 939 U1 | 9/1970 |
| DE | 2 342 024 | 3/1974 |
| DE | 36 11 745 A1 | 10/1987 |
| DE | 39 31 304 A1 | 3/1991 |
| DE | 199 02 171 A1 | 8/2000 |
| DE | 199 42 853 A1 | 4/2001 |
| DE | 100 51 452 A1 | 4/2002 |
| SE | 95 879 | 5/1939 |

OTHER PUBLICATIONS

German Search Report for DE 102 60 212.3.
German Search Report for DE 102 60 211.5.
International Search Report for PCT/EP2003/014099.

* cited by examiner

*Primary Examiner*—Huyen Le
(74) *Attorney, Agent, or Firm*—Duane Morris LLP

(57) ABSTRACT

That end of a wall-mounting support for a shower head that is coordinated to the wall may be pivoted about a horizontal axis. A holder, into which a shower head may be inserted, is provided on the far end of the wall-mounting arm. That holder may also be pivoted about a horizontal axis.

24 Claims, 5 Drawing Sheets

SHOWER SUPPORT

BACKGROUND OF THE INVENTION

The invention is based on an arrangement, by which a shower head, which may be detachable, if desired, is supported such that it may be pivoted.

That hand-held shower head may be attached to a console using, for example, conical holders whose heights are adjustable on a wall-mounted rod, is generally known. The wall-mounted rod allows adjusting the height of the shower head to suit the heights of user having various heights and pivoting it in order to change its angle of inclination.

A shower fixture where a pivotable shower head is attached to the far end of a wall-mounted arm, which, in turn, is attached to a console such that it is pivotable thereon, is also known. The water supply to that shower head takes place through the wall-mounted arm, which is configured in the form of a length of hollow, profiled stock (cf. German Patent DE 100 48 987).

Also known is a shower fixture (SE 95 879) where a receptacle for inserting the grip of a hand-held shower head is arranged on the far end of an adjustable, wall-mounted arm. The wall-mounted arm has a joint situated approximately midway along its length.

BRIEF SUMMARY OF THE INVENTION

The invention is based on the problem of creating a simply constructed shower fixture that provides users with additional showering opportunities.

In order to solve that problem, the invention proposes a shower support having those features stated in the pending claims. Elaborations on the invention are covered under subclaims.

In elaborating on the invention, it may be provided that the wall-mounting arm jutting out of the mounting fixture is pivoted on the mounting fixture and the holder for the shower head that is attached to the wall-mounting arm, in the vicinity of that end thereof that is opposite the mounting fixture is pivoted on the wall-mounting arm. That arrangement of dual pivots allows orienting the direction of the stream of water exiting the shower head more closely around users' desires. Furthermore, it will no longer be necessary to adjust the height of the mounting fixture by sliding it along a wall-mounted rod if the wall-mounted arm proves too long or short, although such will, of course, still be possible.

In elaborating on the invention, it may be provided that the axis about which the holder for the shower head pivots is orthogonal to the longitudinal axis of the wall-mounted arm. Although the wall-mounted arm is not necessarily straight, it may be presumed to have an approximate longitudinal axis that is orthogonal to the axis about which the shower head pivots.

The pivot axis on the mounting fixture for mounting the wall-mounted arm thereon may have arbitrary orientations. However, it will be particularly sensible if it is parallel to the surface of a wall, to which the mounting fixture is fastened, where the wall involved may be any vertical surface of a shower stall or similar, and need not be a bathroom wall. Of course, the mounting fixture may also ride on a vertical or horizontal rod.

In further elaborating on the invention, it may be provided that the pivot axis is horizontal and passes between the mounting fixture and the wall-mounting arm.

It will be particularly sensible if the two pivot axes are parallel to one another, in which case, for example, in order to preserve the direction of the stream of water exiting the shower head, the holder for the shower head may be pivoted in the opposite direction when the wall-mounted arm is pivoted upward, which is why it may also be provided that the maximum pivot angle of the holder for the shower head, relative to the wall-mounted arm, is at least equal to the maximum pivot angle of the wall-mounted arm, relative to the mounting fixture.

In elaborating on the invention, it may be provided that the wall-mounting arm in configured such that it is forked, at least in the vicinity of its far end, in which case, the holder for the shower head may be arranged between the two tines of the fork.

The forking of the wall-mounting arm might, for example, commence approximately midway along its length.

In further elaborating on the invention, it may be provided that the pivot axis of the holder for the shower head intersects the shower head near its centroid (near the centroid of the shower head housing in the embodiments shown), which will lead to the absolute position of the shower head's housing remaining unchanged when the direction of water exiting the shower head is changed by pivoting the shower head.

In elaborating on the invention, it may be provided that the holder for the shower head is configured to engage a location on the shower head's housing that is not recognizable as such and acts by means of an interference fit in the withdrawal/insertion direction, which will allow attaching a shower head to the shower-head support, where the support need not be joined to a device that engages the hand-held shower head's grip. In particular, there are no visible indications that the shower head is intended for, and suitable for, attachment to a wall-mounted support. Designers thus have much greater freedom in designing the shower head and its housing.

In particular, the holder may be configured such that it engages the outer perimeter of the shower head's housing.

In particular, the holder should be configured such that it engages a location on the shower head's housing that is provided for that purpose, but is not recognizable as such from its shape. The properties of certain locations on the outer surface of its housing might also be configured for holding purposes, without affecting the shape thereof, which, in the case of that further elaboration, will also preclude that that particular location, or those particular locations, thereon will be recognizable as intended for interaction with the holder from the shape of the shower head's housing.

The invention proposes that, in elaborating thereon, the shower head remain functional while detached from the holder in order that may be employed as a shower head, both while it is attached to the wall-mounting support and while it is detached therefrom, which will significantly improve its utility.

According to the invention, it may be provided that holder is rigidly attached to the wall-mounting arm. However, the holder, together with the shower head inserted therein, may also be pivotable about an axis orthogonal to the longitudinal axis of the wall-mounting arm, and that particular option is covered by the invention. This latter option will allow adjusting the angle of the shower head in order to vary the direction of the exiting stream of water.

The shower support may be permanently mounted on, for example, a wall, a column within a shower stall, a rod mounted on a wall, or a length of profiled stock mounted on a wall, using the mounting fixture, in which case, its mountings may be such that it may be adjusted.

In elaborating on the invention, it may be provided that the wall-mounting arm is pivotable about an axis parallel to the wall, in the vicinity of that end thereof that is coordinated to the mounting fixture, which may be used to adjust it to suit users of various heights. That axis may be horizontal, and may also be rotatable about an axis orthogonal to the wall.

In the event that both the wall-mounting arm and the holder are arranged such that they are pivotable, in elaborating on the invention, it may be provided that the two pivot axes are parallel to one another, in which case, the orientation of the shower head inserted into the holder thereon may be counter-adjusted in order to correct for the change in direction of the stream of water exiting therefrom when the wall-mounting arm is pivoted.

In order to arrive at a particularly sensible and, in spite of the shower head's not having been specially adapted to fit in the holder, reliable, mounting, according to the invention, it may be provided that the holder engages two, diametrically opposed, locations on the shower head's housing.

The holder may, for example, have a pair of jaws that are configured for engaging the shower head's housing, for that purpose.

According to the invention, it may be provided that the jaws are drawn together while a shower head is inserted therein. That drawing together may be effected by inserting the shower head therein.

In further elaborating on the invention, it may be provided that the two jaws on the holder are connected by a component exerting a tensioning thereof that causes their contacting surfaces to abut against the shower head.

In particular, the clamping component may be configured such that contact between the clamping component and shower head will occur at least two locations on the latter while a shower head is inserted therein, which may be accomplished by adapting the shape of the clamping component to suit the shape of the shower head's housing, or by configuring the clamping component such that it is flexible.

The clamping component, or tensioning component, that connects the jaws on the holder may also be configured such that it does not contact the shower head's housing at any location thereon.

The forking of the wall-mounting arm will allow arranging the holder between the two tines of its fork.

The forking of the wall-mounting arm may, for example, extend over its full length. However, the forking may also commence anywhere between the mounting fixture and the far end thereof, preferably approximately midway along its length, and such is covered by the invention.

The arm may also have no forking, and the holder for the shower head may be arranged in the vicinity of the far end thereof, in which case, the shower head may be arranged on either side of the arm, or centered on its tip.

According to the invention, it may be provided that the shower head is configured in the form of a hand-held shower head having a grip attached to its housing. However, the shower head is attached to the holder by means of its housing, rather than its grip.

Employing a shower head with a disk-shaped housing has proven particularly beneficial.

The hose leading to the shower head may, preferably, be connected to the mounting fixture, in which case, the mounting fixture may be connected to the building's plumbing installations via some other arrangement.

In particular, the clamping component may be configured such that the clamping component can be grasped for manipulating the arm while the shower head is detached.

BRIEF DESCRIPTION OF THE SEVERAL VIEWS OF THE DRAWING

Other features, details, and benefits of the invention will be evident from the claims and the abstract, whose wordings are herewith made part of this description by way of reference thereto, the following description of a preferred embodiment of the invention, the claims and the abstract, and the figures, which depict:

DETAILED DESCRIPTION OF THE INVENTION

Figure 1:
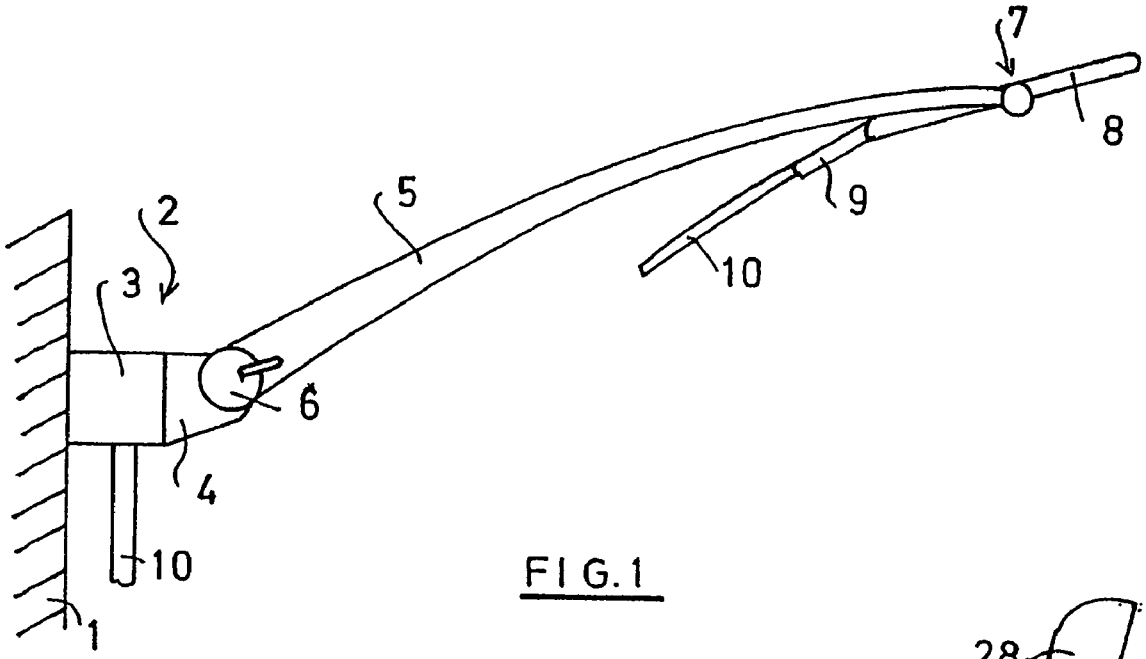
FIG. 1 a schematized side view of a shower support according to the invention.

FIG. 1 depicts a greatly simplified side view of a shower support according to the invention. In the case of the example shown, this shower support is mounted on a wall 1. A mounting fixture 2, which, in the case of the example shown, is in the form of a console 3 that, for example, is bolted to the wall, serves to attach it to the wall. Within the console 3, the shower support is connected to a water line coming from a mixer faucet. A wall-mounting arm 5 is pivoted on a protrusion 4 on the console 3. Its pivot axis is horizontal and normal to the plane of the paper. A setscrew that may be operated by a knob 6 holds the wall-mounting arm 5 in place at a particular angular position. The wall-mounting arm extends outward from the mounting fixture 2, away from the wall, and terminates at its far end 7. A receptacle, which is not depicted in detail in FIG. 1, for a shower head 8 is attached to the wall-mounting arm 5, in the vicinity of the latter's far end 7. In the case of the embodiment shown, the shower head 8 is disk-shaped, and has a handgrip 9 that is slightly angularly offset with respect to the plane of the shower head 8. A shower hose 10 that is fed through the handgrip 9 hangs downward therefrom, details of which have not been shown. The other end of the shower hose 10 is connected to the mounting fixture 2. As has been mentioned, the wall-mounting arm 5 may be pivoted about a horizontal axis in order that it may be take on various angular positions with respect to the wall when pivoted upward and downward. The angular travel of the wall-mounting arm is, for example, 180.degree.

Figure 2:
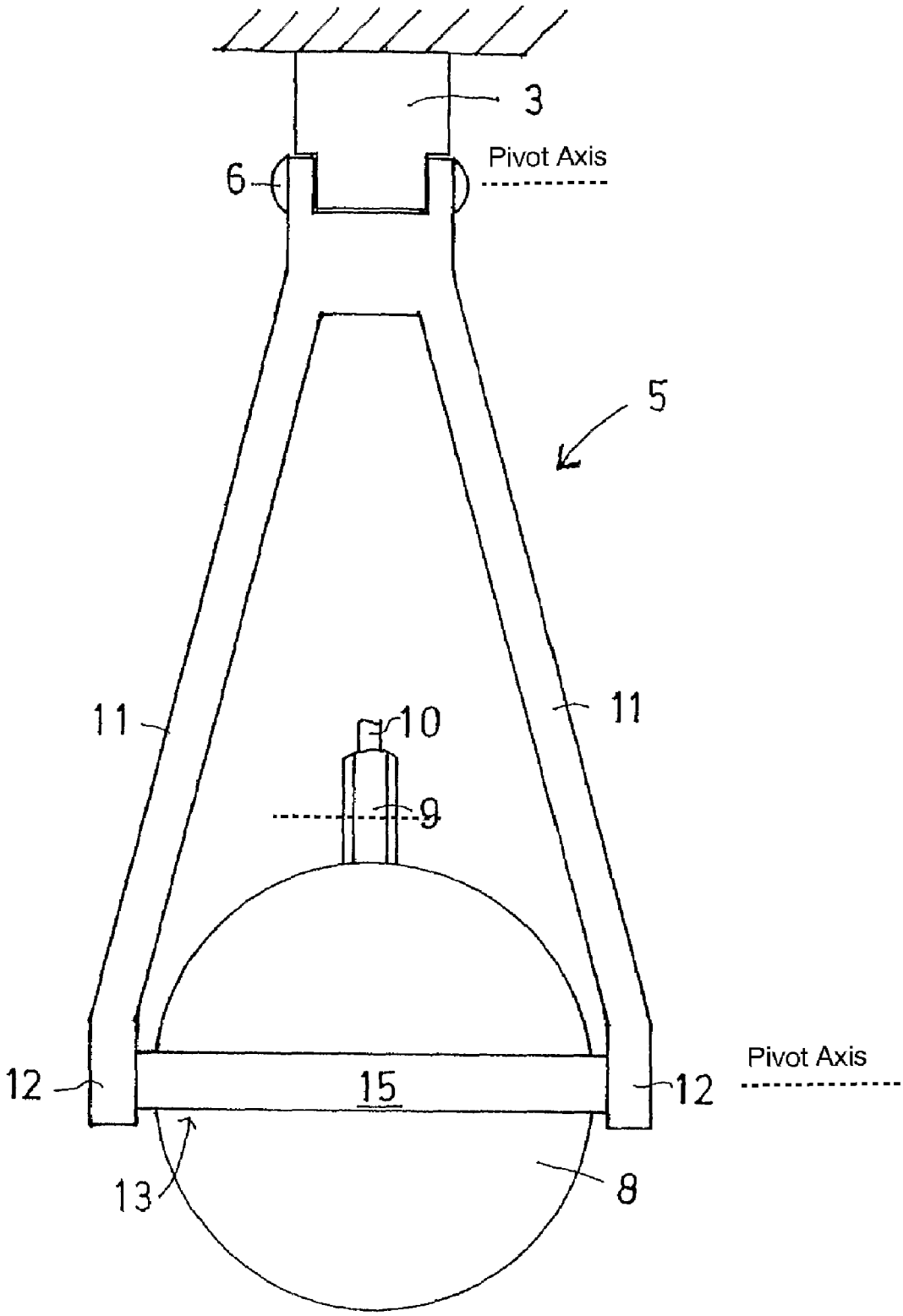
FIG. 2 a simplified, schematized, top view of the arrangement shown in FIG. 1.

FIG. 2 depicts a simplified view of the arrangement shown in FIG. 1. Commencing a short distance away from the location thereon where it is attached to the console 3, the wall-mounting arm 5 splits, thereby forming a pair of tines 11 that are configured such that they diverge, but become parallel to one another in the vicinity of the far end 7 of the wall-mounting arm, where a holder 13 that has been mentioned earlier is provided between the tips 12 of the tines 11. The holder retains the shower head 8, which is therefore situated between those tips 12.

Figure 3:
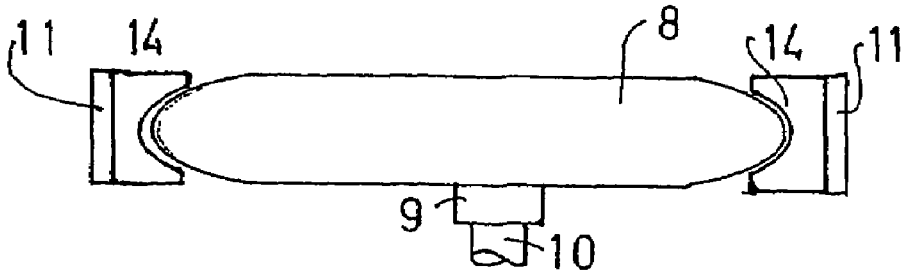
FIG. 3 an end view of a variation on the embodiment.
Figure 4:
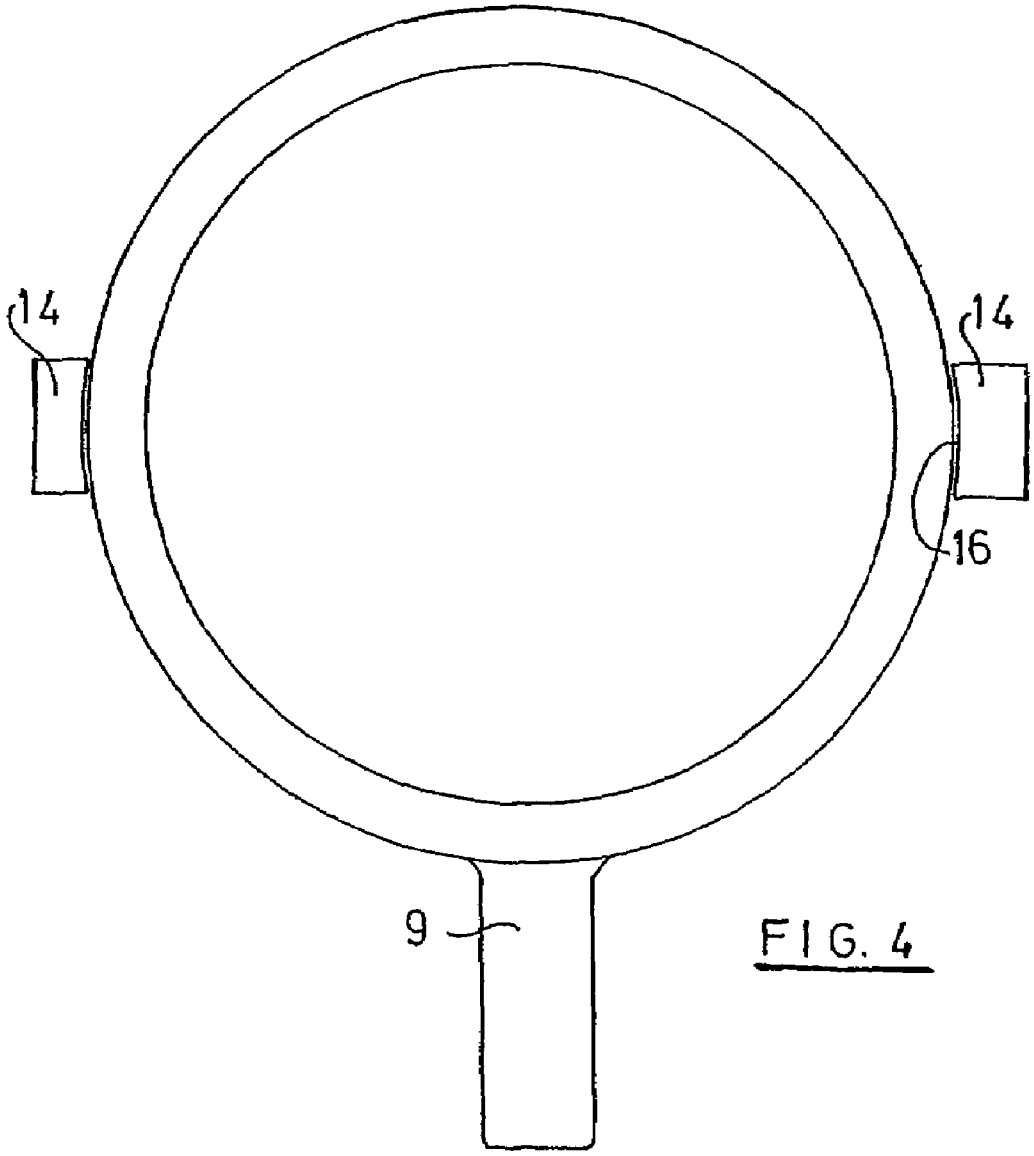
FIG. 4 a view of the shower head.

How the holder looks will be evident from a first example thereof shown in FIG. 3. The housing of the shower head 8 is disk-shaped and configured to have a perimeter that is approximately elliptical. Arranged on the on the inner surfaces of the two tines 11 of the wall-mounting arm 5 are a pair of jaws 14, whose inner surfaces have contours that match the contour of the outer surface of the shower head's housing, which will allow their accommodating the shower head 8 by means of a sort of interference fit, where the interference fit acts upward and downward. However, their clamping action normal to the plane of the paper is by means of a tensioning of the jaws. Either an indirect clamping in each of the clamping jaws 14 or a tensioning of the two clamping jaws 14 toward one another occurs for that purpose. That tensioning of the two clamping jaws 14 toward one another may be obtained by providing that their separation is somewhat less than the corresponding lateral dimension, or diameter, of the housing of the shower head 8, which will provide a tensioning due to inserting the shower head's housing into the gap between the two clamping jaws 14, along a direction normal to the plane of the paper. The tensioning will thus be due to a deformation of the pair of tines 11 of the wall-mounting arm. The extensions of the clamping jaws 14 normal to the plane of the paper in FIG. 3 are relatively short in order that they will engage the shower head's housing over a very short length 16 along its circumference at two, diametrically opposed, locations thereon only, which is depicted in simplified form in FIG. 4.

Figure 5:
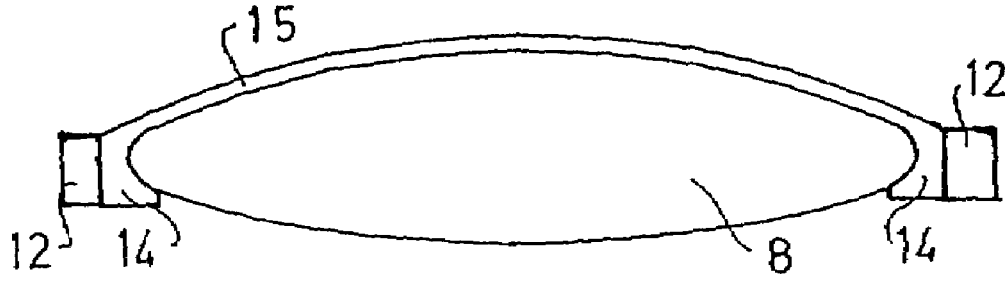
FIG. 5 a view, corresponding to that of FIG. 3, of a slightly modified embodiment.

FIG. 5 shows how the pair of jaws 14 might be interconnected by a bail 15 that is either adapted to suit the shape of the housing of the shower head 8 or is configured such that it is flexible enough to adapt to suit its shape. The bail 15, which is essentially stressed in tension, may reinforce the clamping action.

The pair of clamping jaws 14 are mounted on the tips 12 of the tines 11 of the wall-mounting arm such that they may be rotated in order that the holder, together with the shower head 8, may be pivoted about a horizontal axis. A detenting component, similar to the knob 6 shown in FIG. 1, may be provided in order to clamp the shower head in place at a certain position.

The shower head may be grasped by its grip 9 and withdrawn from the holder along a direction normal to the plane of the paper, preferably toward the wall. If the contours of the inner surfaces of the jaws 14 (cf. FIG. 4) are arcs of circles, a certain detention of the shower head's housing in the holder will also occur, without need for the shower head's housing having a shape such that it may be recognized that it has been designed to be held in place at the locations thereon involved. While the shower head is withdrawn from the holder, there are no signs that it is intended for attachment to a shower support.

Figure 6:
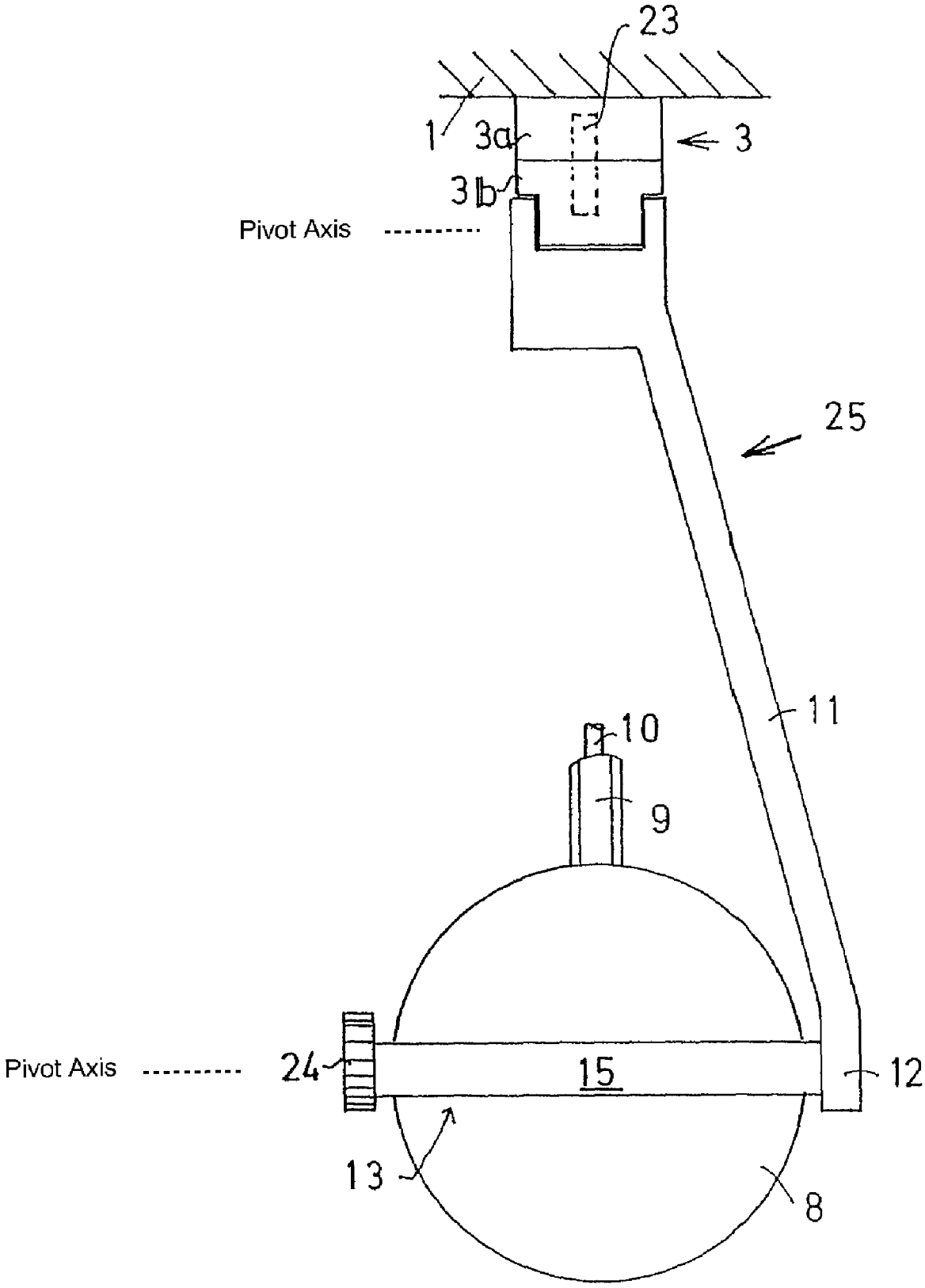
FIG. 6 a view, corresponding to that of FIG. 2, of an asymmetric, wall-mounting arm.

The embodiment shown in FIG. 6 differs from the foregoing embodiments in that the wall-mounting arm 25 is merely a single arm 11 that, however, is asymmetrically arranged, rather than forked. A holder 13 is arranged on one side of the arm 11, in the vicinity of its far end 12. In this case as well, the holder 13 may contain a tensioning component 15 that draws the two jaws 14 on the holder toward one another, at least while the housing of the shower head 8 is inserted therein. A knurled knob 24 may be attached to one end of the tensioning component in order to rotate it about the outer axis.

In this case, the console 3, which is fastened to the wall 1, consists of two-parts 3*a*, 3*b*. The part 3*b*, which carries the pivot axis for the wall-mounting arm 25, may be rotated as a whole about an axis 23 that is orthogonal to the surface of the wall, and thus horizontal, and is indicated by the dashed line.

Of course, an embodiment, wherein the arm 11 is straight and extends outward, away from the console 3, and the holder 13 is attached to the midpoint of the tip 12 of the arm 11 is also feasible.

Figure 7:
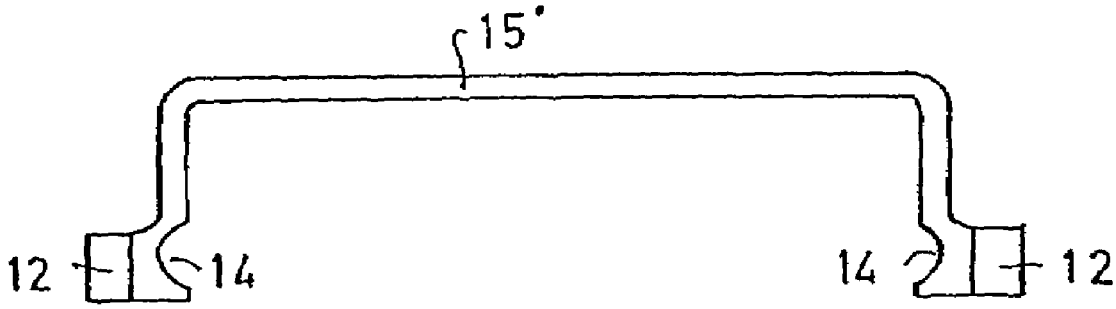
FIG. 7 a view, corresponding to that of FIG. 5, of a holder for a shower head.

FIG. 7 depicts a representation corresponding to that of FIG. 5 of a holder 13 for the housing of a shower head 8, where, in the interest of greater clarity, the housing of the shower head 8 has been deleted. The tensioning component 15' connecting the two jaws 14 is configured in the form of a bail running parallel to the line joining them in order that the housing of the shower head 8 will not come into contact with the tensioning component 15' when it is inserted into the jaws 14. Nevertheless, this component 15' is also configured in the form of a tensioning component in order to generate the clamping force needed for retaining the housing of the shower head 8.

Figure 8:
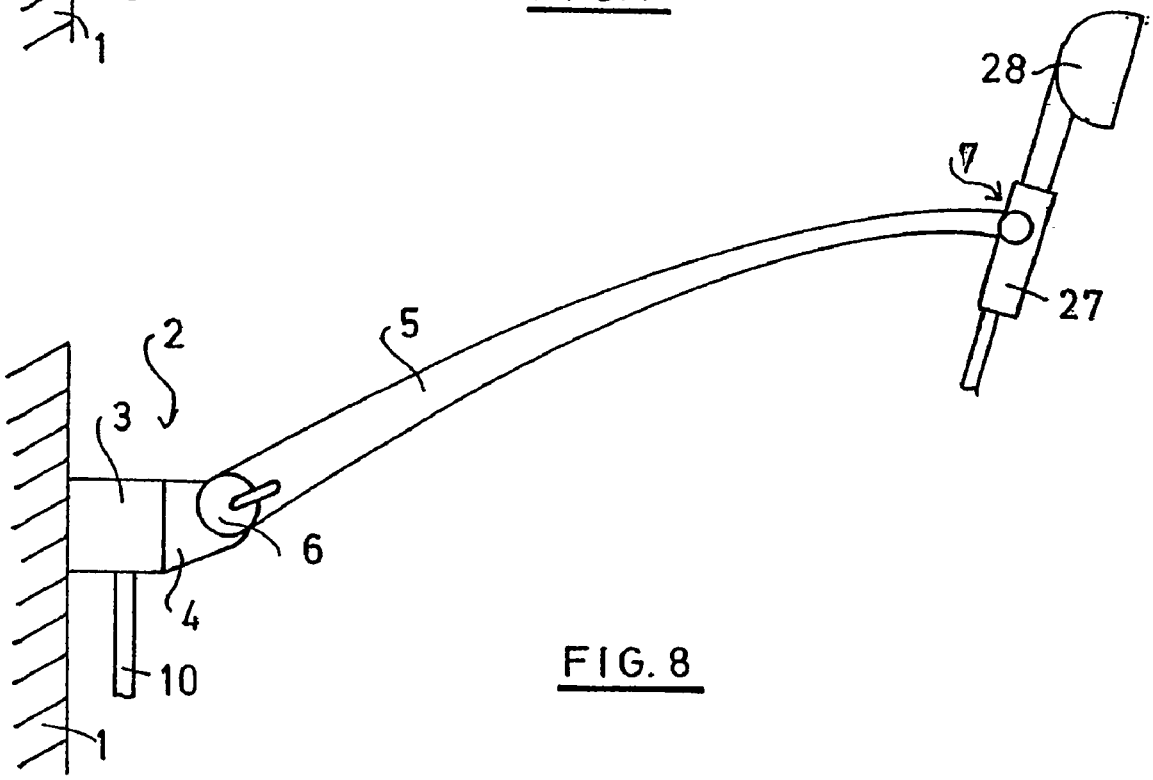
FIG. 8 a view, corresponding to that of FIG. 1, of a modified holder for the shower head.

FIG. 8 depicts an embodiment similar to that shown in FIG. 1, where just the holder for the shower head has been modified. A conical holder 27, into which the grip of the shower head 28 is inserted, is attached to the arm 5, in the vicinity of its far end 7. Conical holders of that type engage the grip, or a cap nut arranged on the end of the grip. The opportunity for attachment proposed by the invention is thus applicable to all types of hand-held shower heads that may be attached to a wall-mounted arm using a holder.

What is claimed is:

1. A support for a detachable shower head, comprising:

a mounting fixture for installing the support for the shower head so as to place the support for the shower head at a fixed location, a wall-mounting arm jutting out of the mounting fixture along a longitudinal axis, a shower head coupled to a water supply by a shower hose, and a holder for the shower head by which the shower head is detachably attachable to the wall-mounting arm, in a vicinity of an end thereof that is opposite from an end of the wall mounting arm pivoted to the mounting fixture, wherein the wall-mounting arm comprises a length of stock pivoted at a near end of the length of stock on the mounting fixture about a pivot axis that is parallel to a surface of a wall on which the support is to be fixed, and pivoted in a vicinity of a far end of the length of stock to the holder on a pivot axis that is parallel to the pivot axis at which the wall-mounting arm is pivoted on the mounting fixture;

wherein the wall-mounting arm is configured to form a fork, at least in the vicinity of its far end from the mounting fixture; and, wherein the shower head is configured to spray water supplied by the shower hose, and remains functional following withdrawal of the shower head from the holder.

2. A shower support according to claim 1, wherein a pivot axis of the holder for the shower head is approximately orthogonal to a longitudinal axis of the wall-mounting arm.

3. A shower support according to claim 1, wherein the wall-mounting arm pivots on the mounting fixture about an axis in a horizontal plane.

4. A shower support according to claim 1, wherein a maximum pivot angle of the holder for the shower head, relative to the wall-mounting arm, at least equals a maximum pivot angle of the wall-mounting arm, relative to the mounting fixture.

5. A shower support according to claim 1, wherein the holder for the shower head is arranged between tines of the fork.

6. A shower support according to claim 1, wherein a pivot axis of the holder for the shower head intersects a housing of the shower head near a centroid thereof.

7. A shower support according to claim 1, wherein the holder for the shower head is configured to engage a location on a housing of the shower head provided for holding it that is not recognizable as such and acts by means of an interference fit in a withdrawal/insertion direction.

8. A shower support according to claim 7, wherein the holder is configured to engage a location on the housing of the shower head provided for holding it that is not recognizable as such, based on its shape at that location.

9. A shower support according to claim 7, wherein the holder is configured to engage an outer perimeter of the shower head.

10. A shower support according to claim 1, wherein the holder, together with the shower head inserted therein, is pivotable about an axis orthogonal to a longitudinal axis of the arm.

11. A shower support according to claim 1, wherein the arm is pivotable about a horizontal axis situated in a vicinity of that end thereof that is coordinated to the mounting fixture.

12. A shower support according to claim 1, wherein the holder engages the shower head at two locations on its surface that are situated approximately opposite one another.

13. A shower support according to claim 1, wherein the holder for the shower head engages a housing of the shower head at two diametrically opposed locations thereon.

14. A shower support according to claim 1, wherein the arm is configured in a form of a rod forming a continuous unit out to its far end, on whose far end the holder for the shower head is arranged.

15. A shower support according to claim 14, wherein the rod is curved.

16. A shower support according to claim 1, wherein the shower head is configured in a form of a hand-held shower head having a grip attached to its housing.

17. A shower support according to claim 1, wherein the shower head comprises a disk-shaped housing.

18. A shower support according to claim 1, wherein a hose leading to the shower head is connected to the mounting fixture.

19. A shower support according to claim 1, wherein the axis about which the holder may be rotated intersects the shower head near a centroid of the shower head.

20. A support for a detachable shower head, comprising:

a mounting fixture for installing the support for the shower head so as to place the support for the shower head at a fixed location, a wall-mounting arm jutting out of the mounting fixture along a longitudinal axis, a shower head coupled to a water supply by a shower hose, and a holder for the shower head by which the shower head is detachably attachable to the wall-mounting arm, in a vicinity of an end thereof that is opposite from an end of the wall mounting arm pivoted to the mounting fixture, wherein the wall-mounting arm comprises a length of stock pivoted at a near end of the length of stock on the mounting fixture about a pivot axis that is parallel to a surface of a wall on which the support is to be fixed, and pivoted in a vicinity of a far end of the length of stock to the holder on a pivot axis that is parallel to the pivot axis at which the wall-mounting arm is pivoted on the mounting fixture;

wherein the holder for the shower head has at least two jaws for engaging a housing of the shower head;

wherein the jaws are tensioned toward one another while the shower head is inserted wherein the two jaws on the holder for the shower head are joined together by a tensioning component; and, wherein the shower head is configured to spray water supplied by the shower hose, and remains functional following withdrawal of the shower head from the holder.

21. A shower support according to claim 20, wherein the tensioning component is configured such that contact between it and a housing of the shower head takes place over an extended area.

22. A shower support according to claim 20, wherein the tensioning component is configured such that a gap between it and a housing of the shower head occurs at least one location.

23. A shower support according to claim 22, wherein the tensioning component is configured such that it does not contact a housing of the shower head at any location thereon.

24. A shower support according to claim 20, wherein the tensioning component is configured to permit grasping of the arm while the shower head is detached.

* * * * *